US011727830B2

(12) United States Patent
Kaufman et al.

(10) Patent No.: US 11,727,830 B2
(45) Date of Patent: Aug. 15, 2023

(54) PLACARD FRAME

(71) Applicant: American Labelmark Company, Chicago, IL (US)

(72) Inventors: Michael J. Kaufman, Morton Grove, IL (US); Michael A. Landis, Gilbert, AZ (US); Andrew U. Chase, Chandler, AZ (US)

(73) Assignee: AMERICAN LABELMARK COMPANY, Chicago, IL (US)

( * ) Notice: Subject to any disclaimer, the term of this patent is extended or adjusted under 35 U.S.C. 154(b) by 0 days.

(21) Appl. No.: 17/236,759

(22) Filed: Apr. 21, 2021

(65) Prior Publication Data

US 2021/0335151 A1 Oct. 28, 2021

Related U.S. Application Data

(60) Provisional application No. 63/013,935, filed on Apr. 22, 2020.

(51) Int. Cl.
*G09F 7/18* (2006.01)
*G09F 21/04* (2006.01)

(52) U.S. Cl.
CPC ..... *G09F 7/18* (2013.01); *G09F 21/048* (2013.01); *G09F 2007/1843* (2013.01); *G09F 2007/1865* (2013.01)

(58) Field of Classification Search
CPC .. G09F 2007/1865; G09F 7/18; G09F 21/048; G09F 2007/1843
See application file for complete search history.

(56) References Cited

U.S. PATENT DOCUMENTS 947,026 A * 1/1910 Peterson ..... G09F 3/18 40/653
1,053,114 A * 2/1913 Seaberg ..... A47G 1/0605 40/766
3,321,855 A * 5/1967 Phelps ..... G09F 3/18 40/325
4,058,918 A 11/1977 Fund
4,106,229 A * 8/1978 Schmid ..... G09F 7/00 40/611.12
4,229,891 A * 10/1980 Keller ..... G09F 7/00 40/590
4,715,138 A * 12/1987 Cherico ..... G09F 21/04 40/591

(Continued)

OTHER PUBLICATIONS

Extended European Search Report of the European Patent Office dated Sep. 17, 2021, in connection with European Application No. 21169827.9, Applicant American Labelmark Company (10 pages).

*Primary Examiner* — David R Dunn
*Assistant Examiner* — Christopher E Veraa
(74) *Attorney, Agent, or Firm* — McCracken & Gillen LLC

(57) ABSTRACT

A placard frame comprises a first frame member and a second frame member spaced from the first frame member and extending therefrom at a margin, wherein the first and second frame members and the margin define an interior space adapted to receive a placard. A projection is disposed on one of the first frame member and the second frame member at a location one of at and adjacent to the margin wherein the projection extends into the interior space. Further, a slot is in communication with the interior space.

20 Claims, 8 Drawing Sheets

(56) References Cited

U.S. PATENT DOCUMENTS

| | | | | |
|---|---|---|---|---|
| 5,442,873 | A * | 8/1995 | Vogler | G09F 15/0012 40/765 |
| 6,308,831 | B1 * | 10/2001 | Saxe | G09F 1/12 206/39 |
| 8,442,508 | B2 | 5/2013 | Harter et al. | |
| 9,235,936 | B2 | 1/2016 | Harter et al. | |
| 9,299,200 | B2 | 3/2016 | Harter et al. | |
| 9,361,737 | B2 | 6/2016 | Harter et al. | |
| 9,441,977 | B1 | 9/2016 | Harter et al. | |
| 9,466,159 | B1 | 10/2016 | Harter et al. | |
| 9,646,351 | B2 | 5/2017 | Harter et al. | |
| 9,678,214 | B2 | 6/2017 | Harter et al. | |
| 9,761,138 | B2 | 9/2017 | Harter et al. | |
| 10,083,549 | B2 | 9/2018 | Harter et al. | |
| 10,085,113 | B1 | 9/2018 | Harter et al. | |
| 10,108,967 | B1 | 10/2018 | Harter et al. | |
| 10,204,533 | B2 | 2/2019 | Kucksdorf et al. | |
| 10,410,547 | B2 | 9/2019 | Kopelke et al. | |
| 2006/0040239 | A1 | 2/2006 | Cummins et al. | |
| 2013/0318843 | A1 | 12/2013 | Nimtz | |
| 2016/0232473 | A1 | 8/2016 | Kuphal et al. | |
| 2016/0300403 | A1 | 10/2016 | Harter et al. | |
| 2016/0300404 | A1 | 10/2016 | Harter et al. | |
| 2017/0039875 | A1 | 2/2017 | Kubiak et al. | |
| 2017/0076517 | A1 | 3/2017 | Harter et al. | |
| 2017/0140680 | A1 | 5/2017 | Kucksdorf et al. | |
| 2017/0206487 | A1 | 7/2017 | Gloudemans et al. | |
| 2018/0253915 | A1 | 9/2018 | Lightner et al. | |
| 2018/0268623 | A1 | 9/2018 | Ambrose et al. | |

* cited by examiner

PLACARD FRAME

CROSS-REFERENCE TO RELATED APPLICATIONS

The present application claims the benefit of Kaufman et al., U.S. Provisional Application Ser. No. 63/013,935, filed on Apr. 22, 2020, and entitled "Placard Frame." The entire contents of this application are incorporated herein by reference.

FIELD OF DISCLOSURE

The present subject matter relates to retention devices, and more particularly to a frame for retaining a placard on a vehicle.

BACKGROUND

A panel comprising a placard having indicia thereon may be secured to a container used to carry or move different products. Such container may be one of an intermediate bulk container, a trailer, railcar, truck, tank (rail or storage), or other vehicle body, a building, or other movable or stationary item. Such indicia may be an image and/or a sequence of characters specified by a regulatory organization (e.g., the U.S. Department of Transportation, the International Maritime Organization, and the like), that identifies the contents of the container and/or whether special care should be taken during transport or storage of such contents.

Placards having particular indicia imprinted thereon associated with particular materials and placard frames that hold such panels are commercially available. The placard frame is secured to a container and a preprinted placard is removably inserted or secured to the placard frame to identify the contents of the container. For example, when the container is used to hold first contents, a first preprinted placard associated with the first contents is selected from a plurality of preprinted placards and inserted into the frame. Thereafter, when the container is used to hold second contents, the first preprinted placard is removed from the placard frame and a second preprinted placard associated with the second contents is selected from the plurality of preprinted placards and inserted into the frame.

Often, the removal and replacement of one placard with another may be problematic, in that during the removal and/or insertion process, the placard becomes cocked i.e., the side edges of the placard are moved out of a parallel condition with respect to the side members of the placard frame. Such an occurrence can cause one or more portions of the placard to be pinched between members of the placard frame and/or trapping of the placard in the placard holder. While the incidence of such a condition can be reduced by increasing the size of the placard frame that receives the placard relative to the placard (the placard size is fixed by regulatory requirements), such a solution to the problem undesirably reduces the ability of the placard frame to retain the placard reliably during transit.

SUMMARY

According to one aspect, a placard frame includes a first frame member and a second frame member spaced from the first frame member and extending therefrom at a margin. The first and second frame members and the margin define an interior space. A projection is disposed on one of the first frame member and the second frame member at a location one of at and adjacent to the margin. The projection extends into the interior space and has a cross-sectional profile comprising one of a linear taper and curved taper. A slot remote from the projection is disposed in communication with the interior space and adapted to permit sliding of a placard therethrough at least one of into and out of the interior space. The one of a linear taper and curved taper forms a shallow angle with the one of the first frame member and the second frame member on which the projection is disposed and prevents pinching or trapping an edge of the placard as the placard is slid into the placard frame.

According to another aspect, a placard frame includes a first frame member and a second frame member spaced from the first frame member and extending therefrom at a plurality of margins. The first and second frame members and the plurality of margins define an interior space. Each of a plurality of projections is disposed on one of the first frame member and the second frame member at a location one of at and adjacent to an associated one of the margins. Each projection extends into the interior space and has a cross-sectional profile comprising one of a linear taper and curved taper. A slot remote from all of the projections is disposed in communication with the interior space wherein the slot is adapted to permit sliding of a placard therethrough at least one of into and out of the interior space. The one of the linear and curved taper of each projection forms a shallow angle with a surface of the one of the first frame member and the second frame member on which such projection is disposed and prevents pinching or trapping an edge of the placard.

According to yet another aspect, a placard frame includes a first frame member and a second frame member spaced from the first frame member and extending therefrom at first and second side margins and an end margin. The first and second frame members, the side margins, and end margin define an interior space. First and second projections are each disposed on one of the first frame member and the second frame member at a location one of at and adjacent to an associated one of the first and second side margins, respectively. Each projection extends into the interior space and has a cross-sectional profile comprising one of a linear taper and curved taper. The placard frame also includes a slot in communication with the interior space and adapted to permit sliding of a placard therethrough at least one of into and out of the interior space, wherein the one of a linear taper and curved taper of the projection forms a shallow angle with the one of the first frame member and the second frame member on which the projection is disposed and prevents pinching or trapping an edge of the placard.

According to one aspect, a placard frame comprises a first frame member and a second frame member spaced from the first frame member and extending therefrom at a margin, wherein the first and second frame members and the margin define an interior space adapted to receive a placard. A projection is disposed on one of the first frame member and the second frame member at a location one of at and adjacent to the margin wherein the projection extends into the interior space. Further, a slot is in communication with the interior space.

According to another aspect, a placard frame comprises a first frame member and a second frame member spaced from the first frame member and extending therefrom at a plurality of margins, wherein the first and second frame members and the plurality of margins define an interior space adapted to receive a placard. The placard from further comprises a plurality of projections each disposed on one of the first frame member and the second frame member at a location one of at and adjacent to an associated one of the margins wherein each projection extends into the interior space. Also, a slot is in communication with the interior space.

According to yet another aspect, a placard frame comprises a first frame member and a second frame member spaced from the first frame member and extending therefrom at first and second side margins and an end margin, wherein the first and second frame members, the side margins, and end margin define an interior space adapted to receive a placard. The placard frame further comprises first and second projections each disposed on one of the first frame member and the second frame member at a location one of at and adjacent to an associated one of the first and second side margins, respectively, wherein each projection extends into the interior space. In addition, a slot is in communication with the interior space.

Other aspects and advantages will become apparent upon consideration of the following detailed description and the attached drawings wherein like numerals designate like structures throughout the specification.

DETAILED DESCRIPTION

Figure 1:
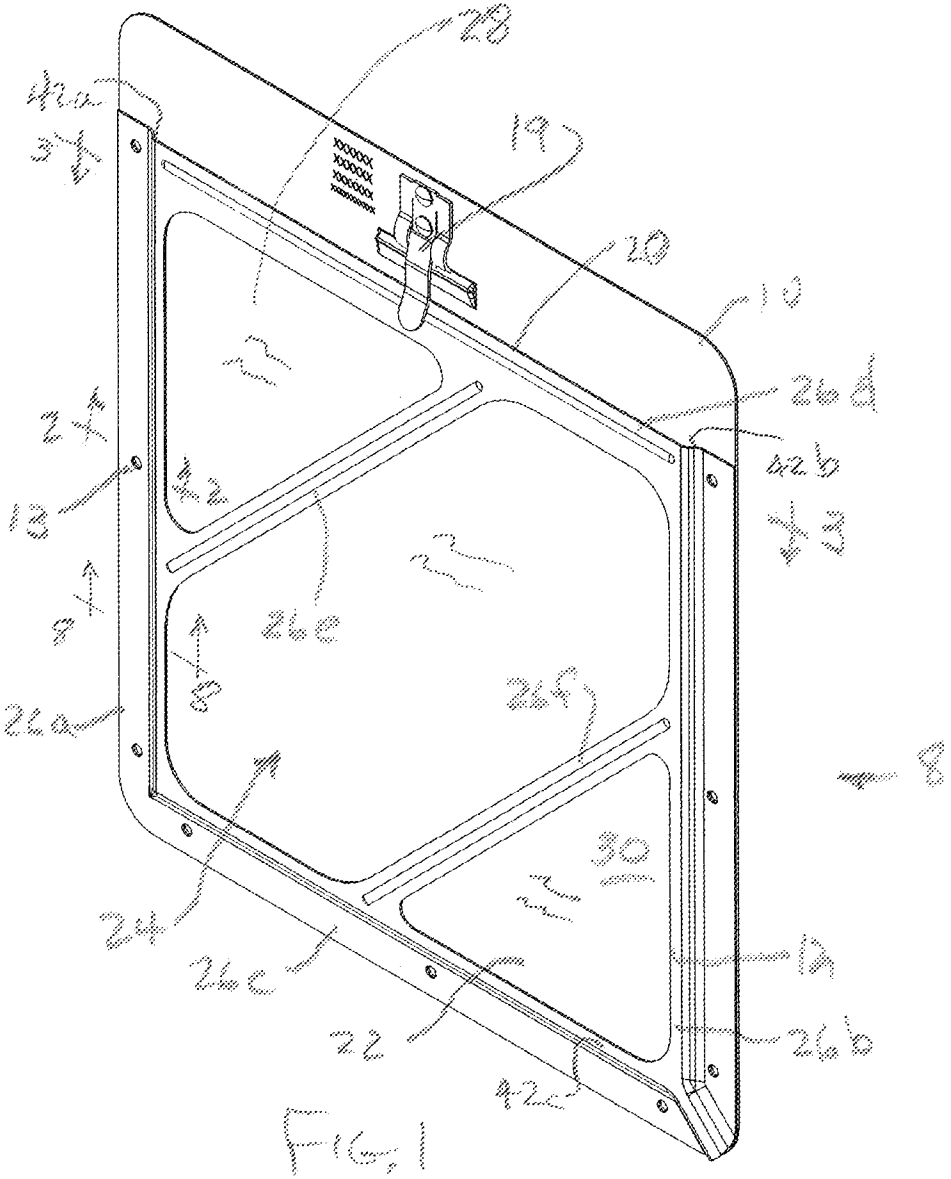
FIG. 1 is an isometric view of an outer portion of a placard frame.
Figure 2:
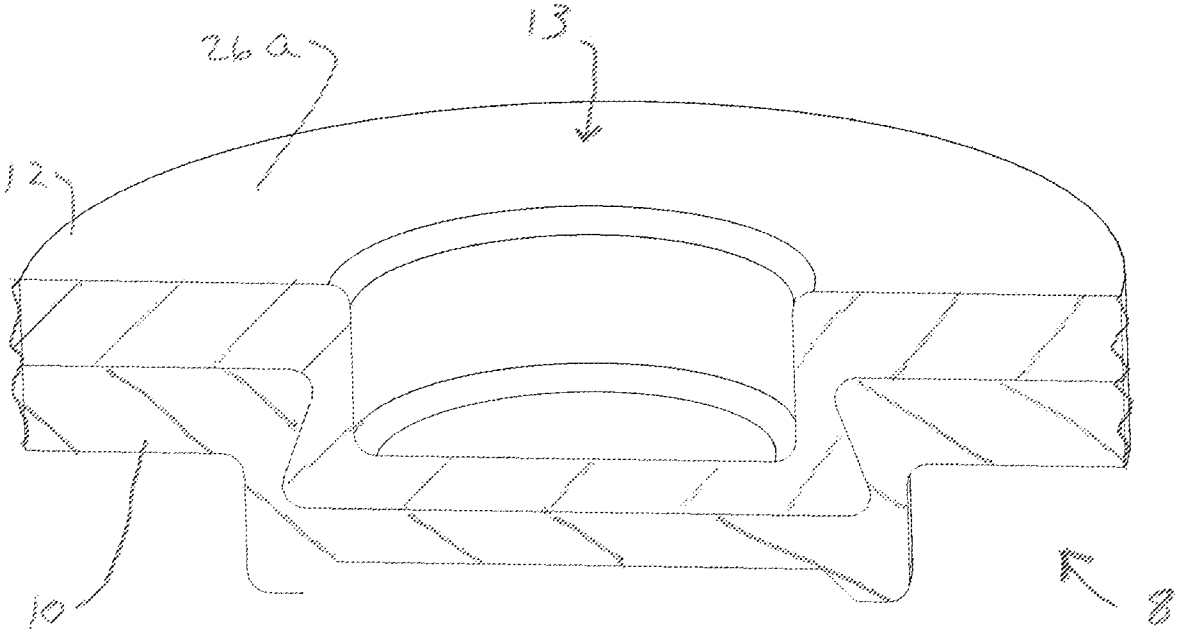
FIG. 2 is a sectional view taken generally along the lines 2-2 of FIG. 1.

Referring to FIG. 1, a frame 8 for holding a placard comprises a first or base frame member 10 and a second frame member 12 joined in any suitable fashion to or integral with the first frame member 10. For example, the second frame member 12 may be secured to the first frame member 10 by one or more of a mechanical clinching joint formed, for example, by a Tox® tool (Tox® is a registered trademark of Tox Pressotechnik GMBH & Co. KG CORPORATION of Riedstrasse 4 Weingarten, Germany D-88250). Alternatively, a clinching joint made by tooling marketed by BTM (Tog-L-Loc® Clinching), Bollhoff-Attexor (Rivclinch®), and/or Eckold may be used and/or one or more rivets, mating bolts and nuts, one or more screws, one or more welds, adhesive, etc., or combinations thereof may be used. Thus, for example, FIG. 2 illustrates a portion of a frame 8 that comprises a joint 13 formed by a Tox® tool. The frame 8 is secured in any suitable fashion, for example, by any one or more of the above-described fastening apparatus/methodologies, to an item that may comprise an intermediate bulk container (IBC), a trailer, railcar, truck, tank (rail or storage), or other vehicle body, building, or other movable or stationary item that may be used to contain and/or move different products.

It should be noted that while a single placard clip 19 and no hinges are shown, a different number of clips (or no clips) and/or one hinges and/or more other structures may be included, if desired.

Figure 3:
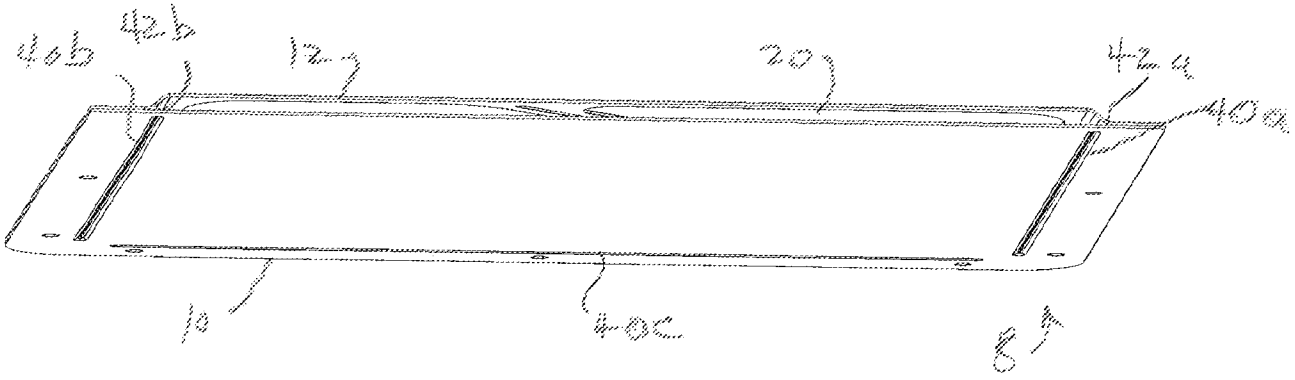
FIG. 3 is a sectional view taken generally along the lines 3-3 of FIG. 1.
Figure 4:
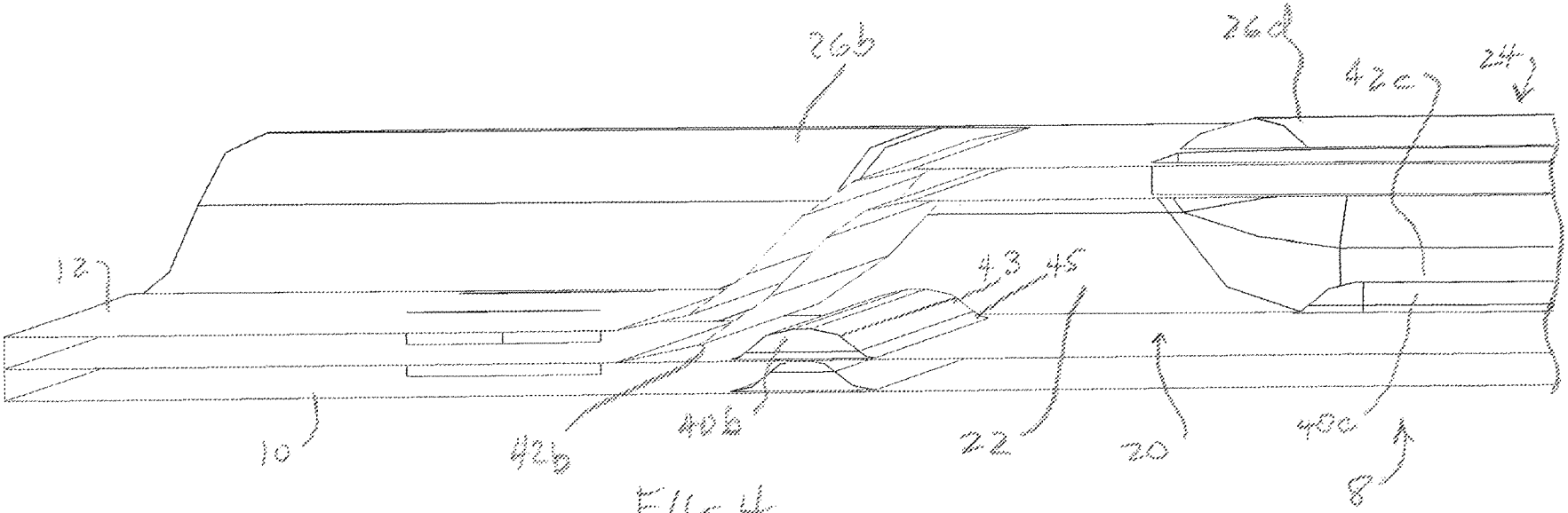
FIG. 4 is an enlarged fragmentary isometric view of the left portion of the placard frame of FIG. 3.

Referring also to FIGS. 3 and 4, the first and second frame members 10, 12 together define a slot 20, which is preferably, but not necessarily, disposed at an upper portion of the frame 8. The slot 20 is adjacent and leads to an interior space 22. The space 22 is defined by the frame members 10, 12, which are spaced from one another at a center portion 24 of the frame 8. The second frame member 12 includes one or more side members **26*a*-26*d* and cross members 26*e*, 26*f* defining a window 28 (FIG. 1). The window 28 is preferably square or rectangular in shape, although the window 28 may have a different shape. The window 28 may be open to the outside or may have a transparent covering. In any event, an item, such as a hazardous item placard 30 (only shown in FIG. 1 in generalized form), is disposed in the space 22 and is observable through the window 28**.

Figure 5:
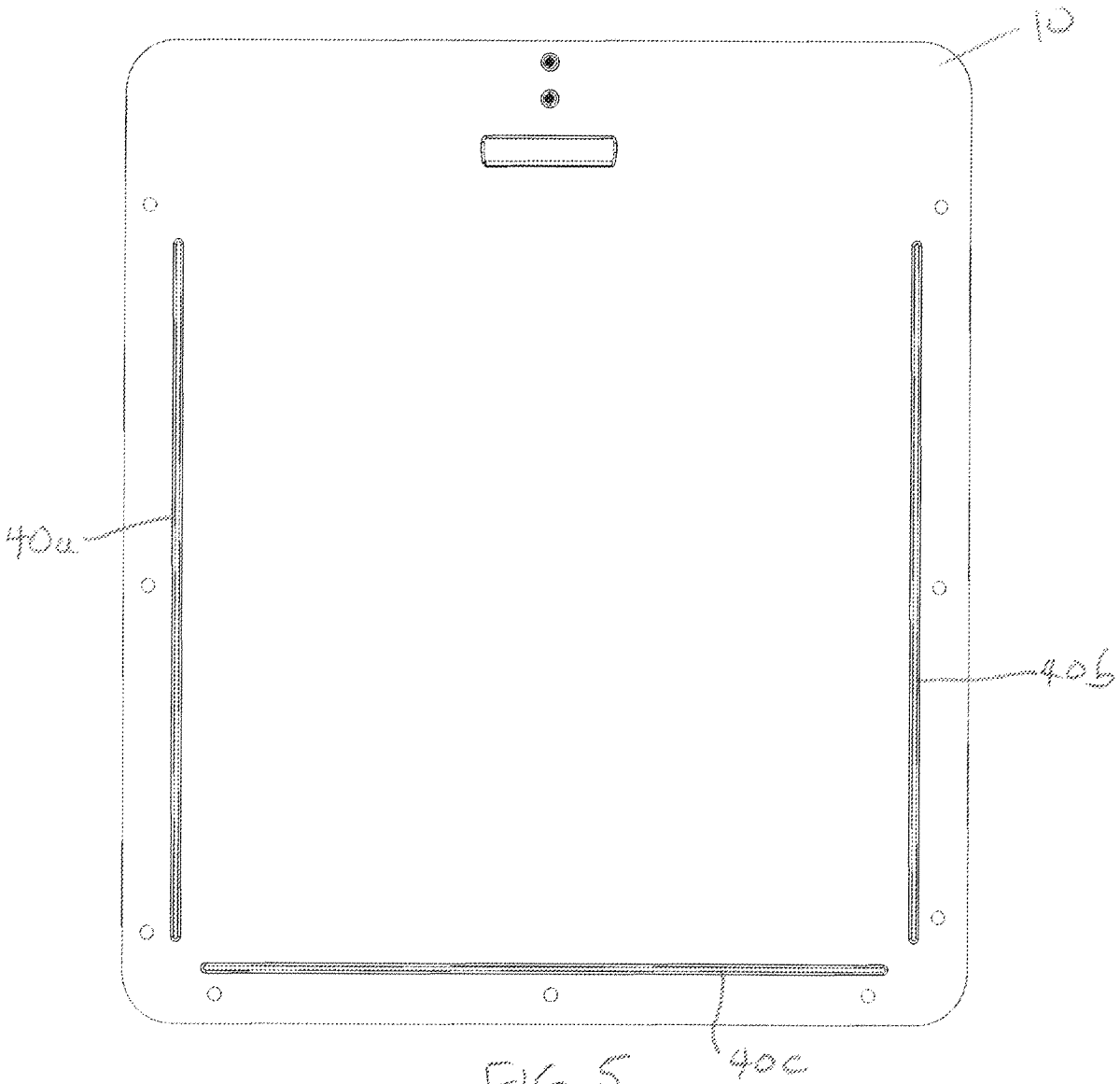
FIG. 5 is a fragmentary elevational view of the placard frame of FIGS. 1-4 with the second frame member omitted therefrom.
Figure 6:
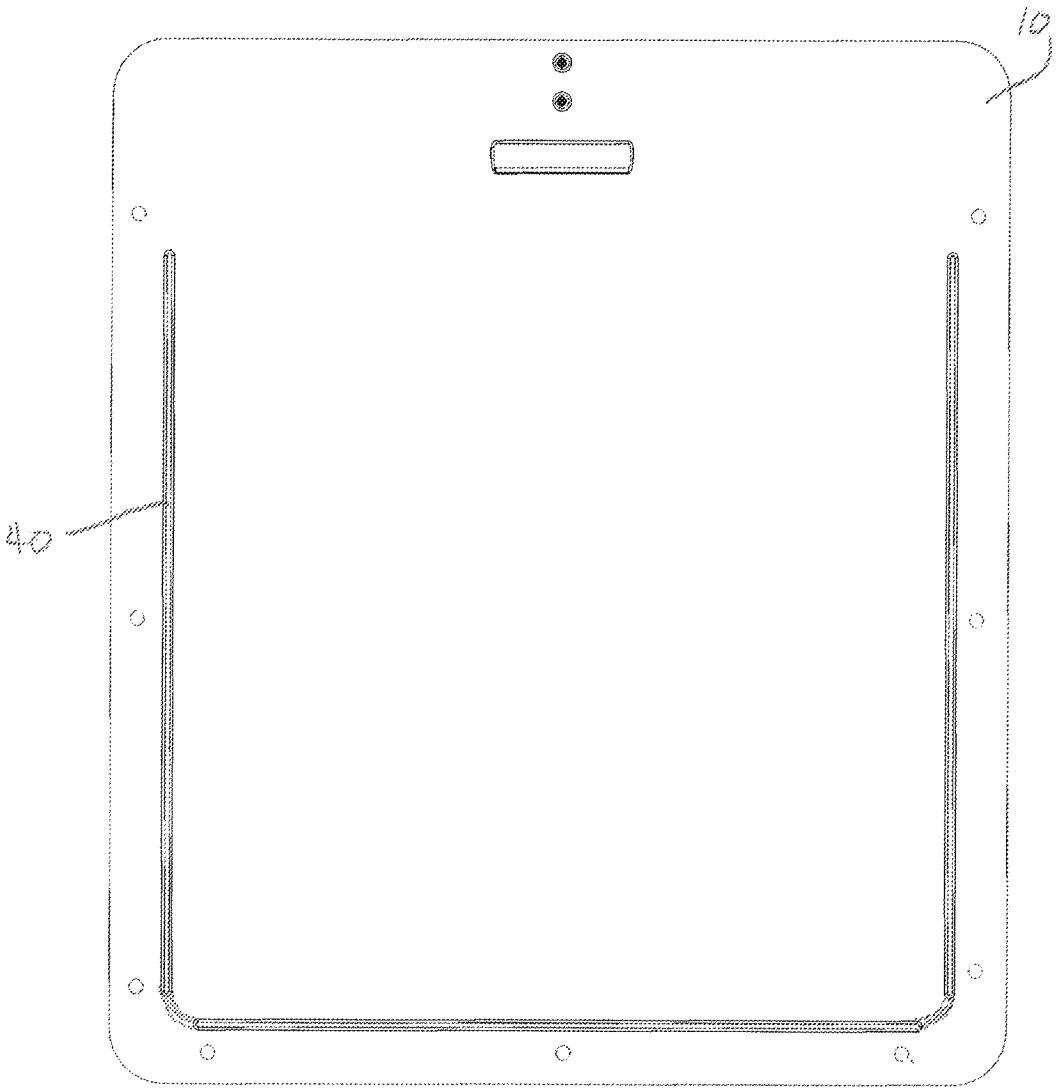
FIGS. 6 and 7 are views identical to FIG. 5 illustrating alternative embodiments.
Figure 7:
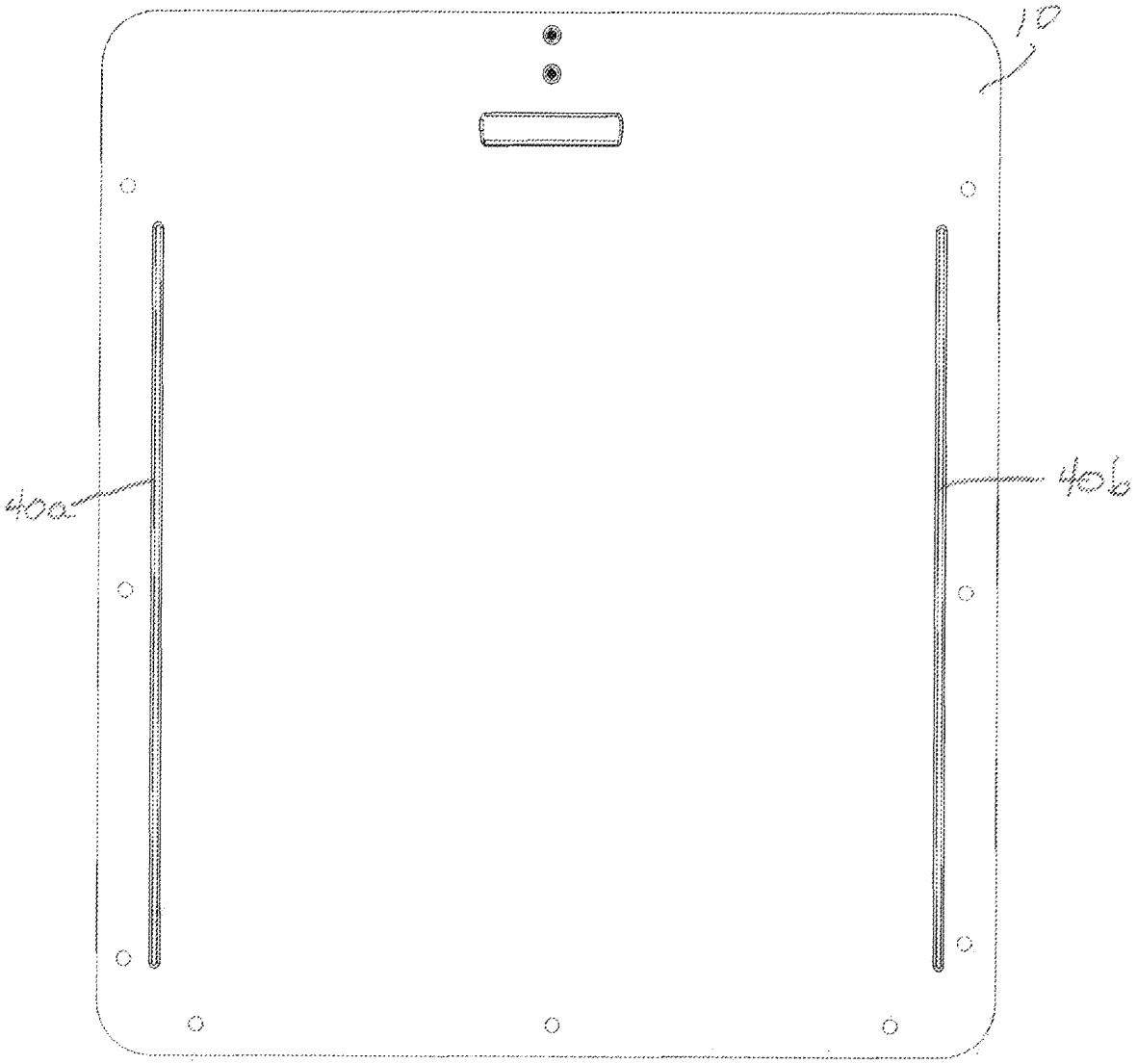

The placard 30 is placed in the interior space 22 by sliding same downwardly (or in another direction depending on the orientation of the frame 8) through the slot 20. Preferably, the placard 30 is sized to fit snugly in the interior space 22 so that movement of the placard 30 therein is restricted. However, the snug fit may result in binding or cocking of the placard 30 as the placard 30 is being inserted into or removed from the interior space 22. This issue is addressed in the illustrated embodiments by the providing one or more upraised portions in the form of projections 40 (visible in FIGS. 3-8) that extend into the interior space 22 from one or both of the frame members 10, 12. More specifically, in a first embodiment shown in FIGS. 3-5, one or more discontinuous upraised portions, such as portions **40*a*-40*c* extending from the first frame member 10 toward the second frame member 12, are disposed at a location at or adjacent to one or more margins, such as side margins 42*a*, 42*b* and end margin 42*c*, defining the interior space 22. If desired, in an alternative embodiment illustrated in FIG. 6, one or more upraised portions 40 may extend fully (or substantially fully) and continuously along the side margins 42*a* and 42*b* and end margin 42*c* defining the interior space 22, although the upraised portion 40 may be discontinuous and/or may extend along only a portion of the margins 42*a*-42*c*, e.g., the upraised portion 40 may comprise portions 40*a*, 40*b* extending fully or partially only along the margins 42*a* and 42*b*, as illustrated in the alternative embodiment of FIG. 7. In any event, the upraised portions 40 assist in guiding the edges of the placard 30 as the placard 30 is inserted through the slot 20 into the interior space 22 to prevent binding or cocking. Preferably, as seen in FIG. 4 in connection with the projection 40*b*, each of the upraised portions 40 has one or both of a smooth (i.e., non-discontinuous) cross-sectional profile or discontinuous cross-sectional profile comprising a linear taper, e.g., at portion 43, or curved taper, e.g., at portion 45, or a bump or other projection(s). Also, the upraised portions are preferably disposed at a shallow angle with respect to the remainder of the frame members 10 and 12 and do not form significant discontinuities with the frame members 10 or 12 that can result in significant pinch points that can grab the side or end edges of the placard 30 and promote seizing of the placard 30**.

Figure 8:
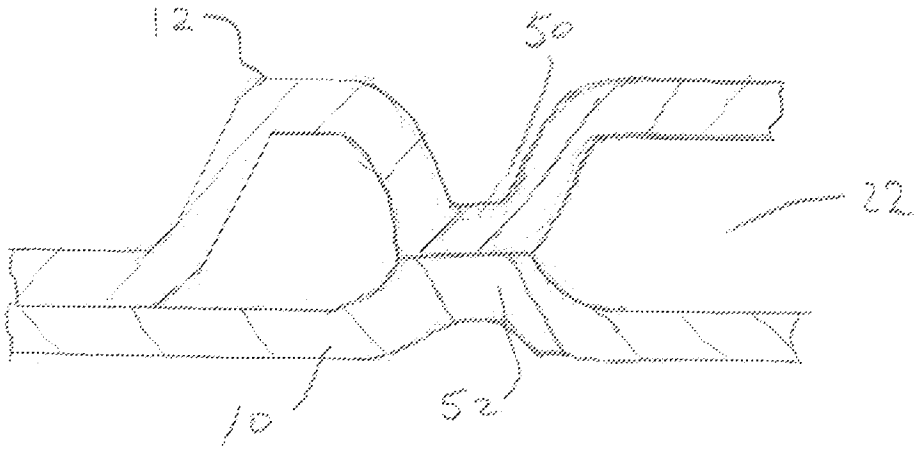
FIG. 8 is a fragmentary sectional view taken generally along the lines 8-8 of FIG. 1 illustrating yet another alternative embodiment.

Referring to FIG. 8, if desired, one or more of the portions 40 may be replaced by one or more downwardly extending portions in the form of projections 50 carried by the second frame member 12 and extending into the interior space 22. Still further, one or more of the portions 40 may be replaced by one or more upraised portion(s) in the form of projection(s) 52 carried by the first frame member 10 and one or more downwardly extending portion(s) comprising the projection(s) 50 carried by the second frame member 12 in register and aligned with the upraised portion(s) 52. In any event, the projections 50 and/or 52 may be sized and shaped to fill the gaps between the members 10 and 12 at margins of the space 22 in such a manner to minimize/eliminate gaps that can catch and trap one or more edges of the placard 30.

INDUSTRIAL APPLICABILITY

In summary, and in accordance with one aspect, a placard frame for use on a trailer, railcar, vehicle body, or other movable or stationary item includes a first frame member, a second frame member joined to the first frame member and forming a slot and an interior space for accepting a placard therein. The interior space is at least partially surrounded by one or more portions that assist in preventing binding or cocking of a placard as the placard is inserted through the slot and into the interior space.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

We claim:

1. A placard frame, comprising:

a first frame member;

a second frame member spaced from the first frame member and extending therefrom at a margin, wherein the first and second frame members and the margin define an interior space;

a projection disposed on one of the first frame member and the second frame member at a location one of at and adjacent to the margin wherein the projection extends into the interior space wherein the projection has a cross-sectional profile comprising one of a linear taper and curved taper; and a slot remote from the projection and disposed in communication with the interior space and adapted to permit sliding of a placard therethrough at least one of into and out of the interior space, wherein the one of a linear taper and curved taper forms a shallow angle with the one of the first frame member and the second frame member on which the projection is disposed and prevents pinching or trapping an edge of the placard as the placard is slid into the placard frame.

2. The placard frame of claim 1, wherein the projection extends fully along the margin.

3. The placard frame of claim 1, wherein the projection extends along a portion of the margin.

4. The placard frame of claim 1, wherein the projection extends discontinuously along the margin.

5. The placard frame of claim 1, wherein the projection comprises discontinuous bumps.

6. The placard frame of claim 1, wherein the projection comprises a first projection disposed on the first frame member and further including a second projection disposed on the second frame member and extending into the interior space aligned with the first projection.

7. The placard frame of claim 1, wherein the projection comprises a first projection and further comprising a second projection, wherein the first projections extends into the interior space from a first surface of the one of the first frame member and the second frame member, the second projection extends into the interior space from a second surface of another of the first frame member and the second frame member, and the first projection and the second projection are in register and contact one another to eliminate a gap between the first frame member and the second frame member and define the margin of the interior space.

8. A placard frame, comprising:

a first frame member;

a second frame member spaced from the first frame member and extending therefrom at a plurality of margins, wherein the first and second frame members and the plurality of margins define an interior space;

a plurality of projections each disposed on one of the first frame member and the second frame member at a location one of at and adjacent to an associated one of the margins wherein each projection extends into the interior space and wherein each projection has a cross-sectional profile comprising one of a linear taper and curved taper; and a slot remote from all of the projections and disposed in communication with the interior space wherein the slot is adapted to permit sliding of a placard therethrough at least one of into and out of the interior space, wherein the one of the linear and curved taper of each projection forms a shallow angle with a surface of the one of the first frame member and the second frame member on which such projection is disposed and prevents pinching or trapping an edge of the placard.

9. The placard frame of claim 8, wherein each projection extends fully along the associated one of the margins.

10. The placard frame of claim 9, wherein each projection extends along a portion of the associated one of the margins.

11. The placard frame of claim 8, wherein each projecti on extends discontinuously along the associated one of the margins.

12. The placard frame of claim 8, wherein each projection comprises discontinuous bumps.

13. The placard frame of claim 8, wherein one of the projections comprises a first projection disposed on the first frame member and another of the projections comprises a second projection disposed on the second frame member and extending into the interior space aligned with the first projection.

14. The placard frame of claim 8, wherein at least one of the plurality of the plurality of projections is disposed at an acute angle with respect to an interior surface of one of the first frame member and the second frame member.

15. A placard frame, comprising:

a first frame member;

a second frame member spaced from the first frame member and extending therefrom at first and second side margins and an end margin, wherein the first and second frame members, the side margins, and end margin define an interior space;

first and second projections each disposed on one of the first frame member and the second frame member at a location one of at and adjacent to an associated one of the first and second side margins, respectively, wherein each projection extends into the interior space and wherein each of the first and second projections has a cross-sectional profile comprising one of a linear taper and curved taper; and a slot in communication with the interior space and adapted to permit sliding of a placard therethrough at least one of into and out of the interior space, wherein the one of a linear taper and curved taper forms a shallow angle with the one of the first frame member and the second frame member on which the projection is disposed and prevents pinching or trapping an edge of the placard.

16. The placard frame of claim 15, further including a third projection disposed on one of the first frame member and the second frame member at a location one of at and adjacent to the end margin.

17. The placard frame of claim 15, wherein each of the first and second projections extends fully along the associated one of the margins.

18. The placard frame of claim 15, wherein each of the first and second projections extends along at least a portion of the associated one of the margins.

19. The placard frame of claim 15, wherein each of the first and second projections extends discontinuously along the associated one of the margins.

20. The placard frame of claim 15, wherein the first projection includes a first portion that extends into the interior from the one of the first frame member and the second frame member and the second projection includes a second portion that extends into the interior from another of the first frame member and the second member, and the first portion and the second portion are in register and in contact with one another to fill a gap between the first and second frame members.

* * * * *